US011193276B2

(12) United States Patent
Potter

(10) Patent No.: US 11,193,276 B2
(45) Date of Patent: Dec. 7, 2021

(54) CLIP INSULATION AND ASSEMBLY

(71) Applicant: Rocheway Pty Ltd, Brisbane (AU)

(72) Inventor: Graeme Potter, Brisbane (AU)

(73) Assignee: Rocheway Pty Ltd, Queensland (AU)

( * ) Notice: Subject to any disclaimer, the term of this patent is extended or adjusted under 35 U.S.C. 154(b) by 37 days.

(21) Appl. No.: 16/273,681

(22) Filed: Feb. 12, 2019

(65) Prior Publication Data

US 2020/0131764 A1 Apr. 30, 2020

(30) Foreign Application Priority Data

Oct. 29, 2018 (AU) ..... 2018101624

(51) Int. Cl.
*E04B 9/20* (2006.01)
*E04B 1/38* (2006.01)
*E04B 2/74* (2006.01)

(52) U.S. Cl.
CPC ..... *E04B 9/205* (2013.01); *E04B 1/38* (2013.01); *E04B 2002/7462* (2013.01)

(58) Field of Classification Search
CPC .... E04B 9/205; E04B 2009/186; E04B 9/001; E04B 9/008; E04B 9/006; E04B 1/38; E04B 2001/8254; E04B 2002/7462; E04B 2/76
See application file for complete search history.

(56) References Cited

U.S. PATENT DOCUMENTS 1,350,349 A 8/1920 Walther
1,610,578 A * 12/1926 Murphy ..... E04B 1/8218 52/402
1,732,348 A * 10/1929 Balduf ..... E04B 1/84 52/346
RE19,431 E 1/1935 Balduf
1,987,568 A * 1/1935 Barge ..... E04B 1/82 52/346
2,115,238 A 4/1938 Stevens
2,968,850 A * 1/1961 Tinnerman ..... F16B 2/246 403/397
3,405,493 A * 10/1968 Omholt ..... E04F 13/0826 52/480
3,553,915 A * 1/1971 Passovoy ..... E04B 2/789 52/241
3,753,324 A * 8/1973 Puccio ..... E04B 2/789 52/377

(Continued)

FOREIGN PATENT DOCUMENTS

EP 1201841 A1 10/2001

OTHER PUBLICATIONS

Non-Final Office Action dated Dec. 9, 2019, issued in U.S. Appl. No. 16/273,596; 15 pages.

(Continued)

*Primary Examiner* — Rodney Mintz
(74) *Attorney, Agent, or Firm* — Wegman Hessler

(57) ABSTRACT

A clip insulation for a furring channel clip, the clip insulation having a substantially planar bed portion having two opposed ends, the bed portion adapted to at least cover a portion of an outer surface of the clip, a plurality of projections extending from the bed portion, and two opposed skirt portions, each skirt portion extending from an end of the bed portion, each skirt portion adapted to attach to an end of the clip.

18 Claims, 8 Drawing Sheets

(56) References Cited

U.S. PATENT DOCUMENTS

| | | | | |
|---|---|---|---|---|
| 4,110,948 | A | 9/1978 | Maier, Jr. | |
| 5,788,206 | A | 8/1998 | Bunker | |
| 6,267,347 | B1 | 7/2001 | Ryan et al. | |
| 7,093,814 | B2 | 8/2006 | Meisel et al. | |
| 7,303,050 | B2 | 12/2007 | Rogger | |
| 7,895,803 | B2 * | 3/2011 | Downey | E04B 1/82 52/511 |
| 9,045,898 | B2 * | 6/2015 | Ravnaas | E04B 2/7409 |
| 9,200,439 | B1 | 12/2015 | Egri, II | |
| D810,545 | S | 2/2018 | Stevens et al. | |
| 10,174,501 | B1 | 1/2019 | Underkofler et al. | |
| 10,844,607 | B2 * | 11/2020 | Potter | E04F 13/0805 |
| 2004/0221972 | A1 * | 11/2004 | Tomlinson | E04B 9/0414 160/327 |
| 2007/0294972 | A1 | 12/2007 | Ducharme | |
| 2008/0017780 | A1 * | 1/2008 | Downey | E04F 13/0805 248/610 |
| 2008/0086966 | A1 * | 4/2008 | Stevens | F16F 1/376 52/347 |
| 2008/0201743 | A1 | 8/2008 | Stevens et al. | |
| 2008/0202846 | A1 * | 8/2008 | Gernhart | F16F 15/04 181/208 |
| 2009/0242726 | A1 | 10/2009 | Carels | |
| 2009/0283359 | A1 * | 11/2009 | Ravnaas | E04B 9/001 181/286 |
| 2010/0251652 | A1 * | 10/2010 | Golden | E04B 9/18 52/489.1 |
| 2014/0318077 | A1 | 10/2014 | Case | |
| 2016/0168846 | A1 * | 6/2016 | Shapiro | E04F 13/08 52/506.05 |
| 2017/0044767 | A1 | 2/2017 | Glottis et al. | |
| 2017/0044773 | A1 | 2/2017 | Gernhart | |
| 2017/0159302 | A1 * | 6/2017 | Gleeson | E04F 15/20 |
| 2018/0238052 | A1 | 8/2018 | Downey et al. | |
| 2019/0153733 | A1 * | 5/2019 | Krause | E04B 1/40 |
| 2020/0123783 | A1 * | 4/2020 | Potter | E04F 13/0805 |

OTHER PUBLICATIONS

Final Office Action dated Apr. 8, 2020, issued in U.S. Appl. No. 16/273,596; 15 pages.
Advisory Action dated Jul. 7, 2020, issued in U.S. Appl. No. 16/273,596; 5 pages.

* cited by examiner

CLIP INSULATION AND ASSEMBLY

CROSS-REFERENCE TO RELATED APPLICATION

This application claims the priority filing benefit of Australian Patent Application No. 2018101624 filed Oct. 29, 2018, which is incorporated herein by reference in its entirety.

FIELD OF INVENTION

The present invention relates to clip insulation. The present invention has particular but not exclusive application for clips mounting a furring channel onto a support structure such as existing building wall or ceiling structures to provide a furring support framework for wall or ceiling cladding. The patent specification describes this use but it is by way of example only and the invention is not limited to this use.

BACKGROUND OF THE INVENTION

Walls and ceilings of buildings are sometimes clad with wall or ceiling cladding to provide an aesthetical appearance, or to cover utilities such as power cables, water pipes, HVAC ducts or the like.

The wall or ceiling cladding is typically secured to the existing wall or ceiling by a support framework of furring channels. The wall or ceiling cladding is typically secured to the furring channels using fasteners such as screws. The furring channels are attached to the wall or ceiling by clips (also referred to as furring channel clips) which are attached on to the wall or ceiling in a spaced apart manner. The furring channels are secured to the clips by positioning them over and snapping them into the clips.

One problem that can arise from such a configuration is a lack of space to accommodate utilities. A prior art solution to this problem is to provide a furring channel of greater thickness.

Another problem that can arise by securing the clips to the wall or ceiling and the wall or ceiling cladding to the furring channels is that vibrations and noise can travel from the wall or ceiling to the wall or ceiling cladding.

One prior art solution to mitigating the transmission of vibration or sound is to provide an underlay between the clip and the wall or ceiling and/or between the wall or ceiling cladding and the furring channel.

OBJECT OF THE INVENTION

It is an object of the present invention to overcome or at least alleviate one or more of the abovementioned problems with furring channel clips and/or provide the consumer with a useful or commercial choice.

SUMMARY OF THE INVENTION

In one aspect, the present invention broadly resides in a clip insulation for a furring channel clip, the clip insulation having a substantially planar bed portion having two opposed ends, the bed portion adapted to at least cover a portion of an outer surface of the clip;

a plurality of projections extending from the bed portion; and two opposed skirt portions, each skirt portion extending from an end of the bed portion, each skirt portion adapted to attach to an end of the clip.

The insulation member preferably includes elastic material to inhibit or reduce vibrations from passing therethrough. The insulation member preferably includes resilient material to inhibit or reduce vibrations from passing therethrough. The insulation member preferably includes a rubber or plastic material to inhibit or reduce vibrations from passing therethrough. More preferably the insulation member includes a rubber material to inhibit or reduce vibrations from passing therethrough.

In one embodiment, the insulation member is made by extrusion. In another embodiment, the insulation member is made by moulding or casting.

The bed portion is preferably substantially rectangular in shape. Preferably the bed portion includes an aperture. Preferably, the aperture of the bed portion aligns with an aperture of the clip in use. Preferably in use, a fastener such as a screw or a bolt can be inserted into the aperture of the bed portion and the aperture of the clip to secure the clip to a support structure.

Preferably in use, when the clip is attached relative to a support structure, the bed portion is located between the clip and the support structure.

In one embodiment, the insulation member includes a grommet extending from the bed portion. Preferably an aperture in the grommet defines the aperture in the bed portion. Preferably the grommet is adapted to be at least partially inserted into the aperture of the body portion.

The grommet preferably includes elastic material to inhibit or reduce vibrations from passing therethrough. The grommet preferably includes resilient material to inhibit or reduce vibrations from passing therethrough. The grommet preferably includes a rubber or plastic material to inhibit or reduce vibrations from passing therethrough. More preferably the grommet includes a rubber material to inhibit or reduce vibrations from passing therethrough.

Preferably in use, the plurality of projections extend in a direction away from the clip. Preferably the plurality of projections extend at substantially 90° from the bed portion. Preferably the plurality of projections extend in substantially the opposite direction compared to the two opposed skirt portions. Preferably in use the plurality of projections provide additional insulation between a clip and a support member to which the clip is attached. In one embodiment, the plurality of projections are ribs. Preferably the ribs are parallel to one another. In another embodiment, the plurality of projections are knobs, nibs or lugs.

In one embodiment, the plurality of projections are between 3 and 16 projections. Preferably the plurality of projections are between 6 and 10 projections. More preferably the plurality of projections are 8 projections.

Preferably the two opposed skirt portions each define a recess to receive an end of the clip to hold the clip insulation in place on the clip. In one embodiment, each recess is defined between a corresponding skirt portion and the bed portion. Preferably each skirt portion is adapted to straddle an end of the clip to hold the insulation member in place on the clip.

Preferably each of the two opposed skirt portions extends at substantially 90° from the bed portion.

Preferably each of the two opposed skirt portions includes a ramp portion. Preferably each ramp portion aids in guiding an end of the clip into a corresponding recess.

In another aspect, the present invention broadly resides in a clip assembly for mounting a furring channel to a support structure, the clip assembly having a clip having a body portion attachable relative to the support structure; and at least one connection portion extending transversely from the body portion, each of the at least one connection portion has two opposed connection positions adapted to connect to the furring channel; and a clip insulation locatable between the clip and the support structure, the clip insulation having a substantially planar bed portion having two opposed ends, the bed portion adapted to at least cover a portion of an outer surface of the clip;

a plurality of projections extending from the bed portion; and two opposed skirt portions, each skirt portion extending from an end of the bed portion, each skirt portion adapted to attach to an end of the clip.

Preferably in use, when the body portion is attached relative to the support structure, the bed portion and the plurality of projections are located between the support structure and the clip.

Preferably, the body portion of the clip is substantially planar. Preferably the body portion is substantially rectangular in shape. Preferably the body portion has two opposed sides and two opposed ends.

Preferably the body portion includes an aperture. The aperture is preferably adapted to receive a fastener such as a bolt or a screw. Preferably the fastener is adapted to attach the body portion relative to the support structure. Preferably the aperture is adapted to receive a grommet. More preferably the aperture is adapted to receive a grommet and a ferrule. Preferably the grommet and/or ferrule prevent direct contact between the body portion of the clip and the fastener.

Preferably each of the at least one connection portion extends at substantially 90° from the body portion. Preferably each of the at least one connection portion extends from a respective one of the two opposed sides of the body portion. Preferably the at least one connection portion is two connection portions. Preferably the two connection portions are opposed to one another. Preferably the two opposed connection portions extend from the two opposed sides of the body portion. Preferably each of the at least one connection portion is substantially planar.

Preferably each of the two opposed connection positions are defined by two opposed notches. Preferably the opposed notches are adapted to retain therein lips of a furring channel. Preferably each of the two opposed connection positions is located between 2 mm to 45 mm away from the body portion of the clip. More preferably, each of the two opposed connection positions is located between 5 mm to 30 mm away from the body portion of the clip. In one embodiment, each of the two opposed connection positions is located substantially 10 mm away from the body portion of the clip. In another embodiment, each of the two opposed connection positions is located substantially 15 mm away from the body portion of the clip. In a further embodiment, each of the two opposed connection positions is located substantially 20 mm away from the body portion of the clip. In yet another embodiment, each of the two opposed connection positions is located substantially 25 mm away from the body portion of the clip.

Preferably the clip is made from metal. Preferably the metal is bent or pressed into the shape of the clip. Preferably the metal is steel. Preferably the thickness of the metal is in the range of 0.5 mm to 1.5 mm More preferably the thickness of the metal is substantially 1 mm Preferably the clip insulation is a clip insulation as described in this specification.

In one embodiment, the clip assembly includes a grommet adapted to be at least partially inserted into the aperture of the body portion.

The grommet preferably includes elastic material to inhibit or reduce vibrations from passing therethrough. The grommet preferably includes resilient material to inhibit or reduce vibrations from passing therethrough. The grommet preferably includes a rubber or plastic material to inhibit or reduce vibrations from passing therethrough. More preferably the grommet includes a rubber material to inhibit or reduce vibrations from passing therethrough.

The clip assembly preferably includes a ferrule. The ferrule is preferably adapted to be inserted into the aperture of the body portion. The ferrule preferably includes a rim portion adapted to prevent the ferrule from passing all the way through the aperture in the body portion. The ferrule is preferably adapted to be inserted into the aperture of the grommet. The ferrule is preferably adapted to accept a fastener to fasten the clip assembly to a support structure. Preferably in use the ferrule prevents the fastener from damaging the clip if the fastener is overtightened. Preferably the ferrule is made of metal. More preferably the ferrule is made of steel.

In a further aspect, the present invention broadly resides in a clip assembly for mounting a furring channel to a support structure, the clip assembly having a clip having a body portion attachable relative to the support structure, the body portion having two opposed sides and two opposed ends; and two opposed connection portion extending transversely from corresponding sides of the body portion, each of the connection portions having two opposed connection positions adapted to connect to the furring channel; and a clip insulation locatable between the clip and the support structure, the clip insulation having a substantially planar bed portion having two opposed ends, the bed portion adapted to at least cover a portion of an outer surface of the body portion of the clip;

a plurality of projections extending from the bed portion; and two opposed skirt portions, each skirt portion extending from an end of the bed portion, each skirt portion adapted to attach to an end of the clip.

Preferably in use, when the body portion is attached relative to the support structure, the bed portion and the plurality of projections are located between the support structure and the clip.

The clip is preferably a clip as described in this specification.

The clip insulation is preferably a clip insulation as described in this specification.

The features described with respect to one aspect also apply where applicable to all other aspects of the invention. Furthermore, different combinations of described features are herein described and claimed even when not expressly stated.

BRIEF DESCRIPTION OF THE DRAWINGS

In order that the present invention can be more readily understood reference will now be made to the accompanying drawings which illustrate a preferred embodiment of the invention and wherein.

DETAILED DESCRIPTION OF THE PREFERRED EMBODIMENT

Figure 1:
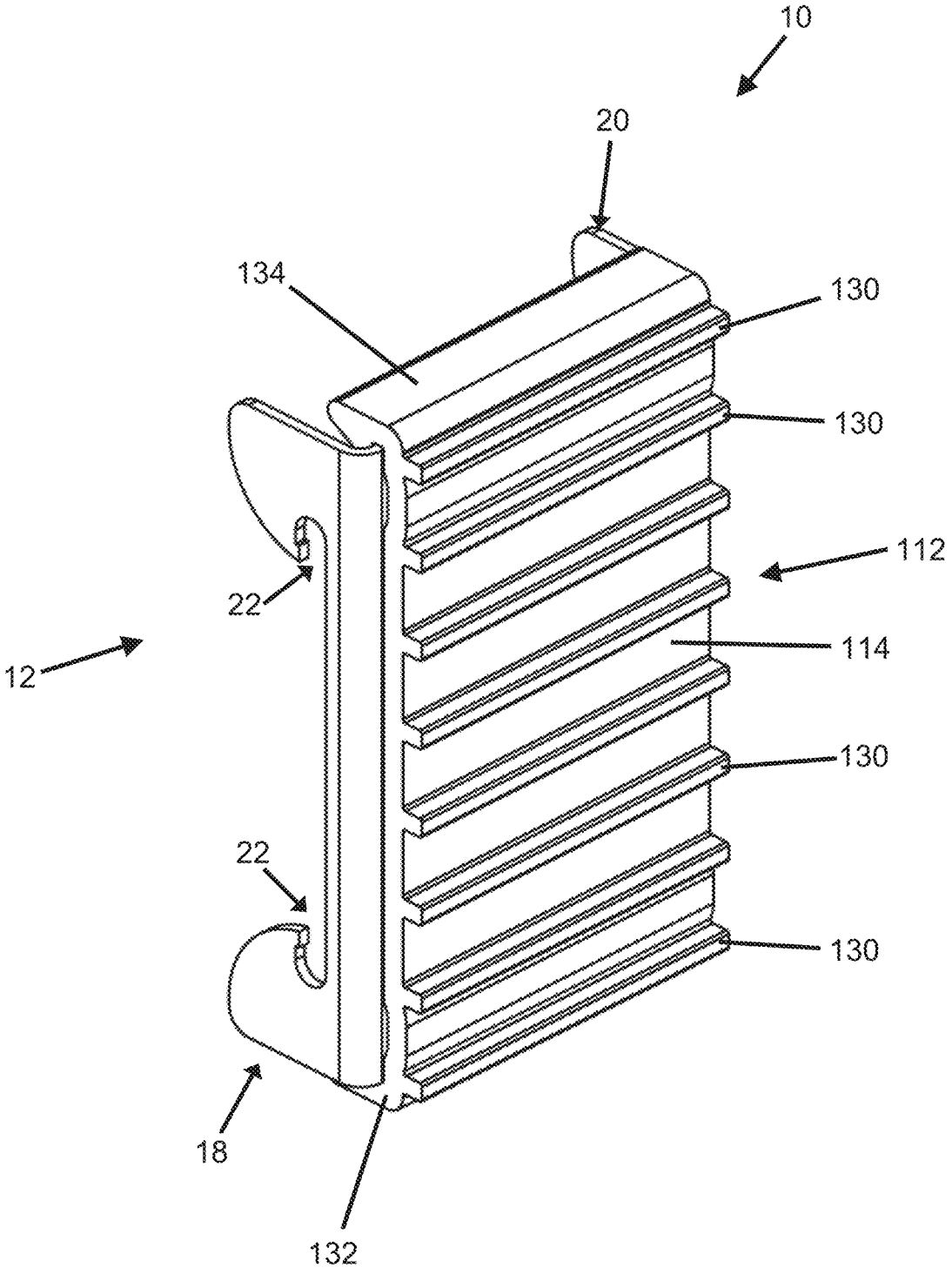
FIG. 1 is a perspective view of a clip assembly according to an embodiment of the present invention.
Figure 2:
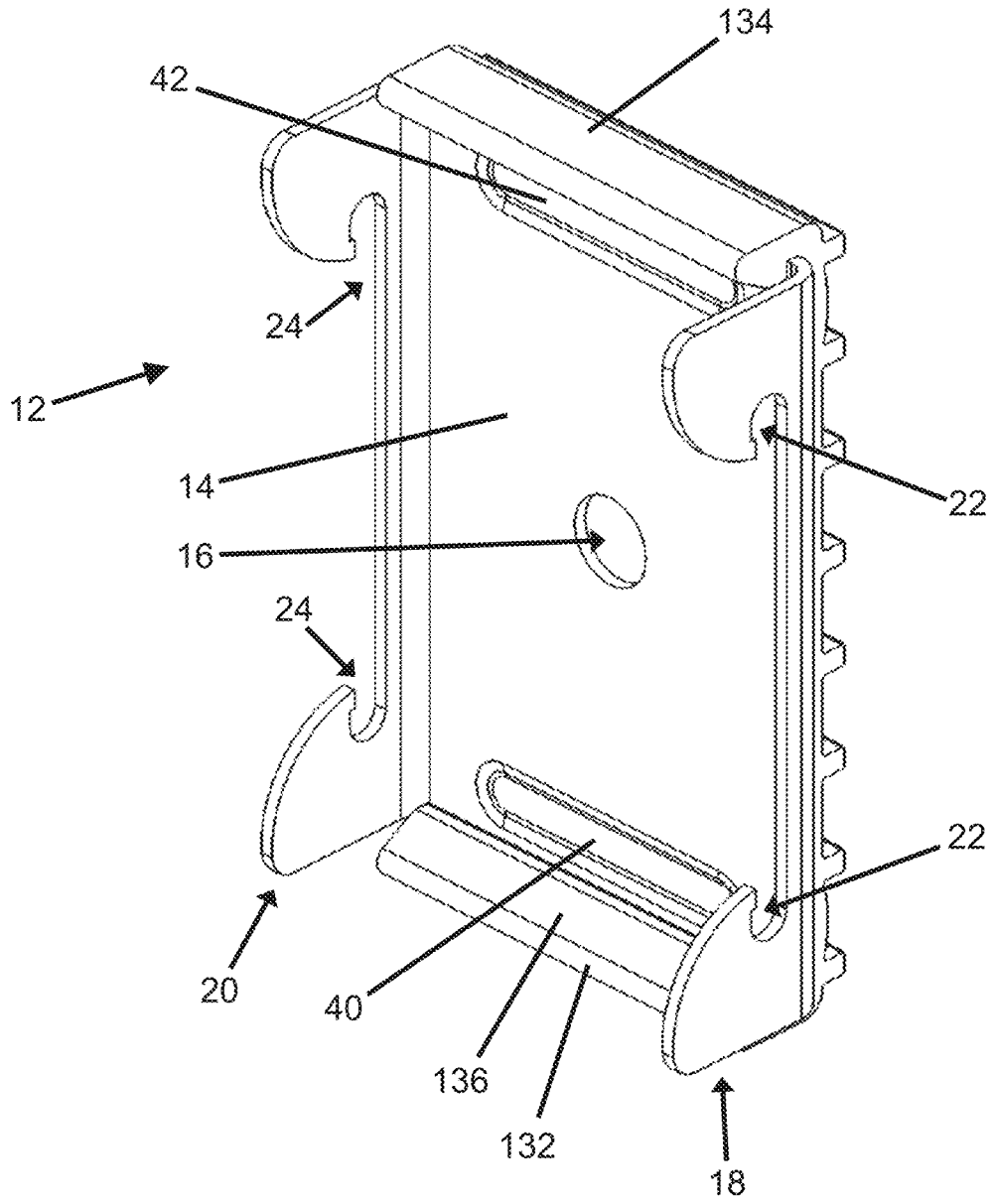
FIG. 2 is a rear perspective view of the clip assembly of FIG. 1.
Figure 3:
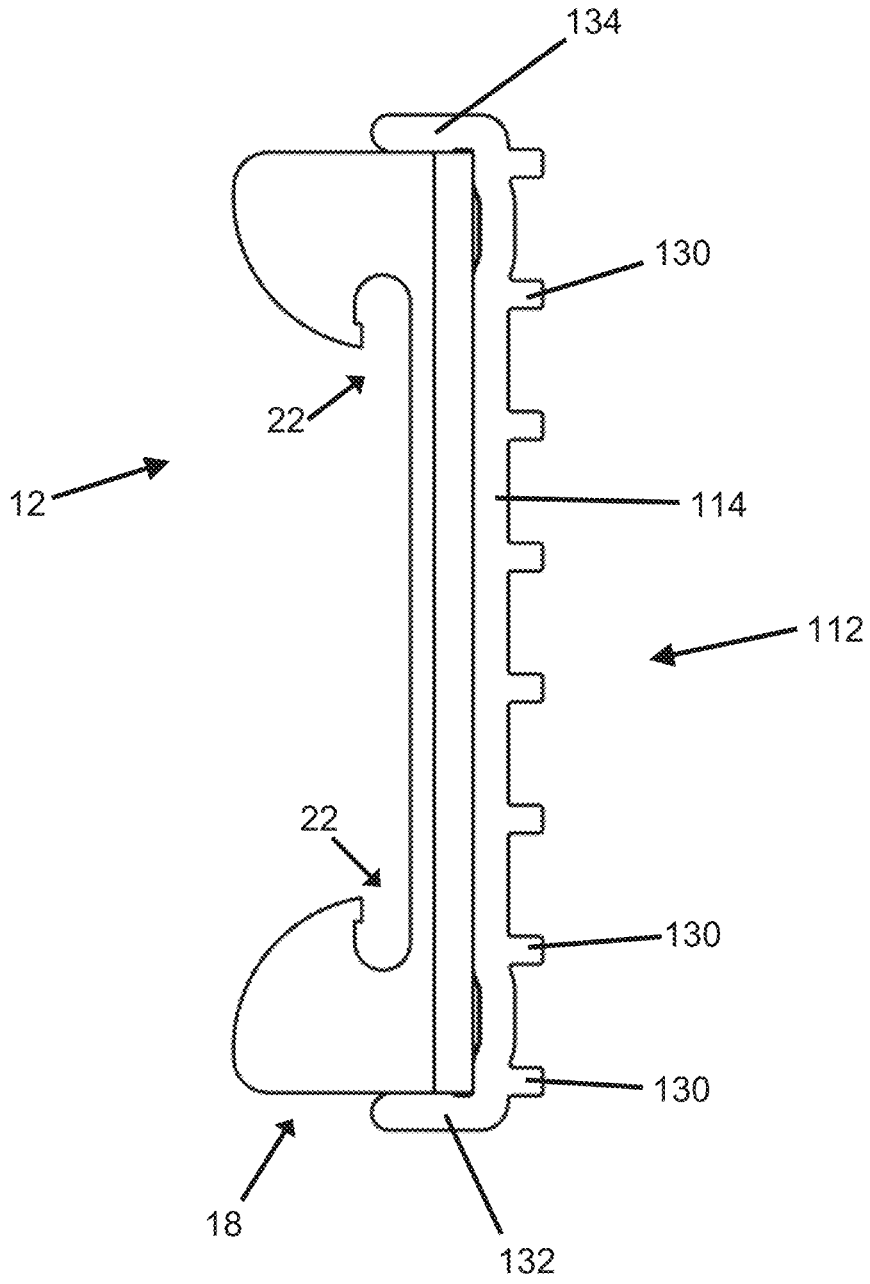
FIG. 3 is a side view of the clip assembly of FIG. 1.
Figure 4:
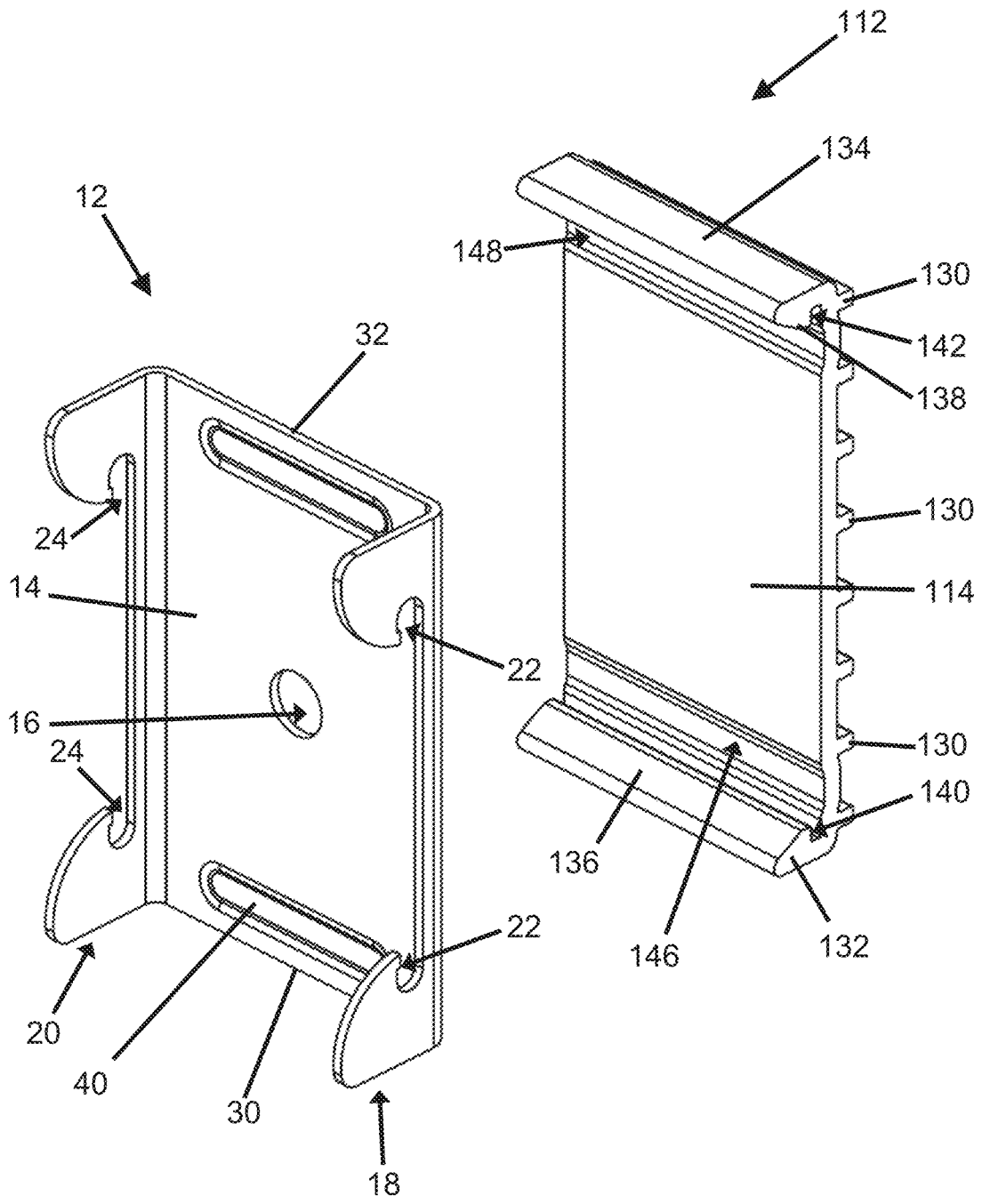
FIG. 4 is an exploded view of the clip assembly of FIG. 1.

With reference to FIGS. 1 to 4, there is shown a clip assembly 10 according to an embodiment of the present invention. The clip assembly 10 includes a clip 12. The clip assembly includes an insulation member 112 to partially cover the clip.

The clip 12 has a body portion 14. The body portion 14 is planar and substantially rectangular. The body portion has an aperture 16 located therethrough. The aperture 16 is adapted to attach the clip assembly 10 to a support structure (not shown) via a fastener (not shown) as will be explained in more detail below.

Two opposed connection portions 18,20 extend at substantially 90° from sides of the body portion 14. Each of the two connection portions 18,20 has two opposed connection positions in the form of recesses 22,24. The recesses 22,24 are adapted to connect to a furring channel (not shown).

The insulation member 112 is made from rubber to inhibit vibrations from passing therethrough.

The insulation member 112 has a bed portion 114. The bed portion 114 is adapted to at least cover a portion of the outer surface of the body portion 14 of the clip 12.

The bed portion 114 has a plurality of projections in the form of ribs 130 extending therefrom.

Skirt portions 132,134 extend at substantially 90° from ends of the body portion 14. Each skirt portion 132,134 is adapted to attach to an end of the body portion 14 of the clip 12 to hold the insulation member 112 in place on the clip 12. Each skirt portion 132,134 has a ramp portion 136,138. The ramp portions 136,138 assist in locating part of each skirt portion 132,134 over ends 30,32 of the body portion 14 of the clip 12.

The skirt portions 132,134 define recesses 140,142. Ends 30,32 of the body portion 14 of the clip 12 are received in the recesses 140,142 to hold the insulation member 112 in place on the clip 12.

In use, when the body portion 14 of the clip is attached relative to a support structure (not shown), the bed portion 114 and the ribs 130 are located between the body portion 14 and the support structure, inhibit vibration from traveling from the support structure through the clip 12 into a furring channel (not shown) and into wall or ceiling cladding (not shown) attached to the furring channel.

The bed portion 114 has two furrows 146,148. The furrows 146,148 receive corresponding ridges 40,42 (reverse side shown) of the clip 12.

Figure 5:
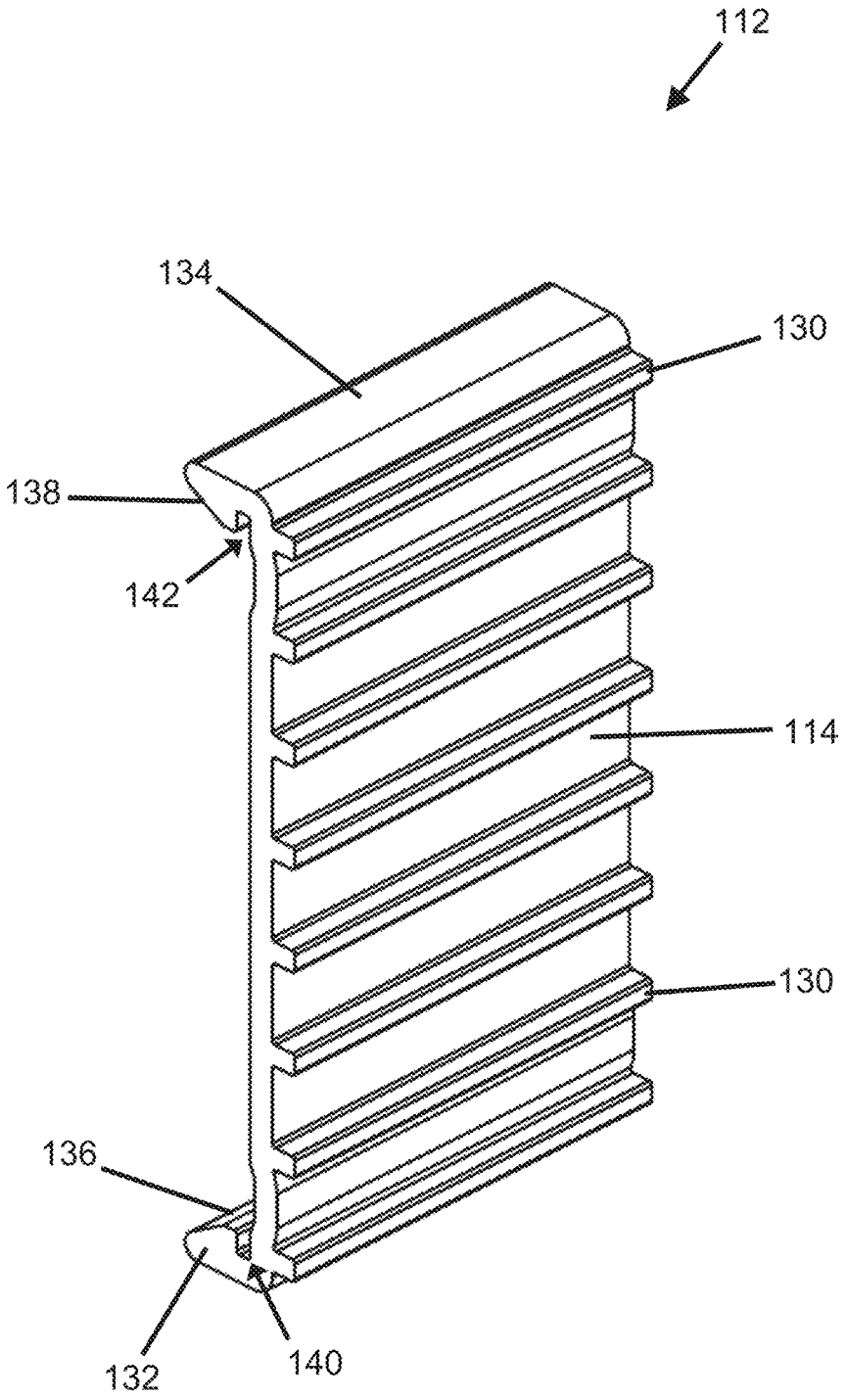
FIG. 5 is a perspective view of a clip insulation according to an embodiment of the present invention.
Figure 6:
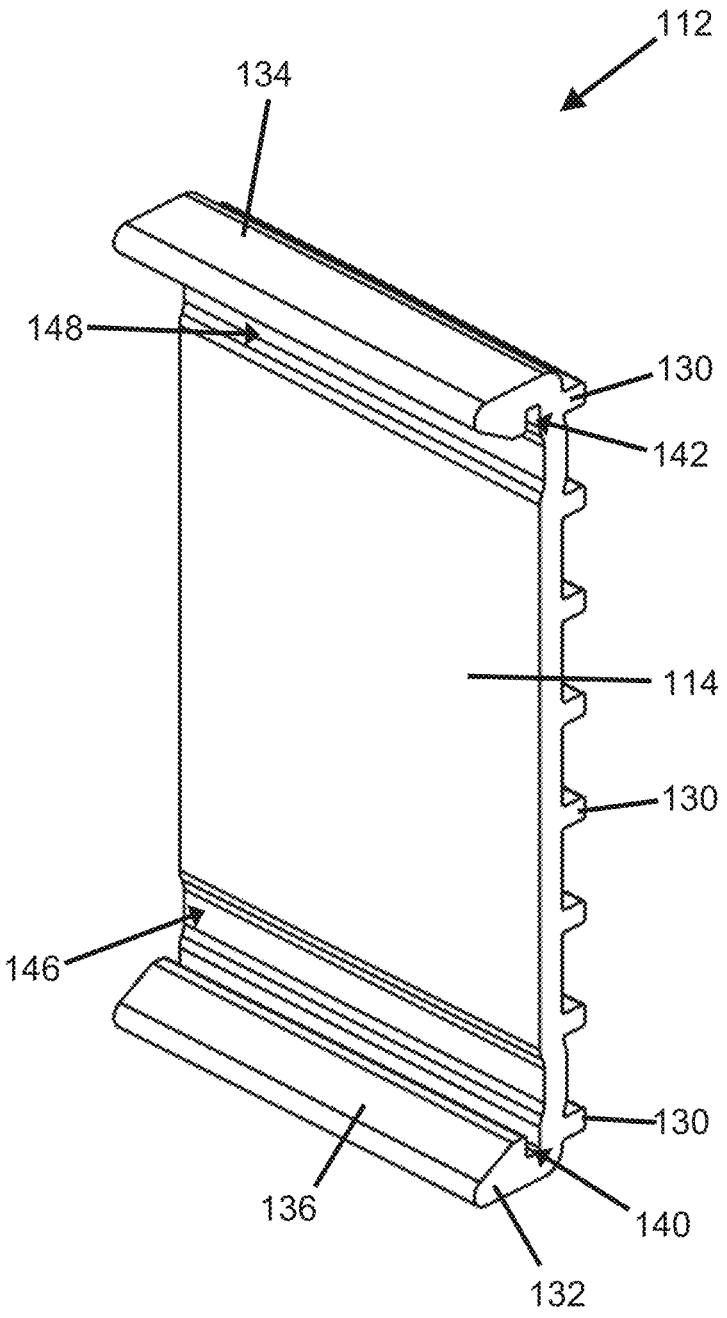
FIG. 6 is a rear perspective view of the clip insulation of FIG. 5.
Figure 7:
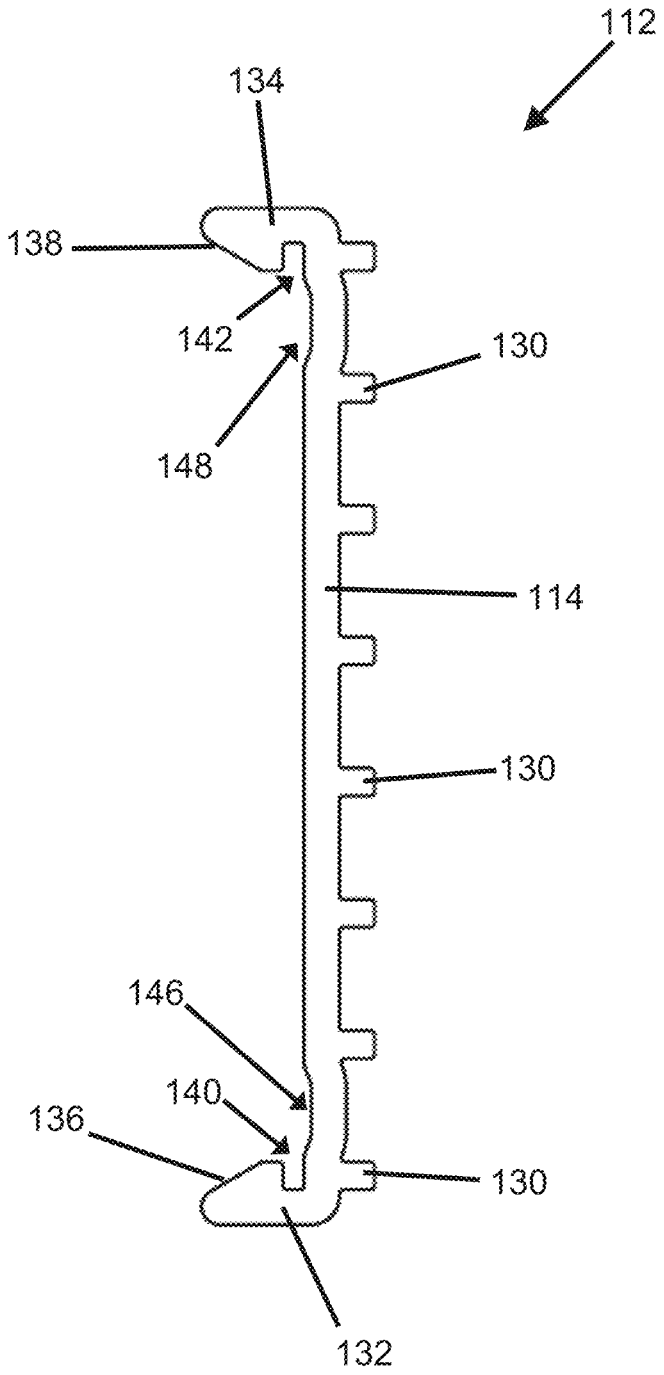
FIG. 7 is a side view of the clip assembly of FIG. 5.

With reference to FIGS. 5 to 7, there is shown the insulation member 112 of the clip assembly 10 of FIGS. 1 to 4 in more detail.

Figure 8:
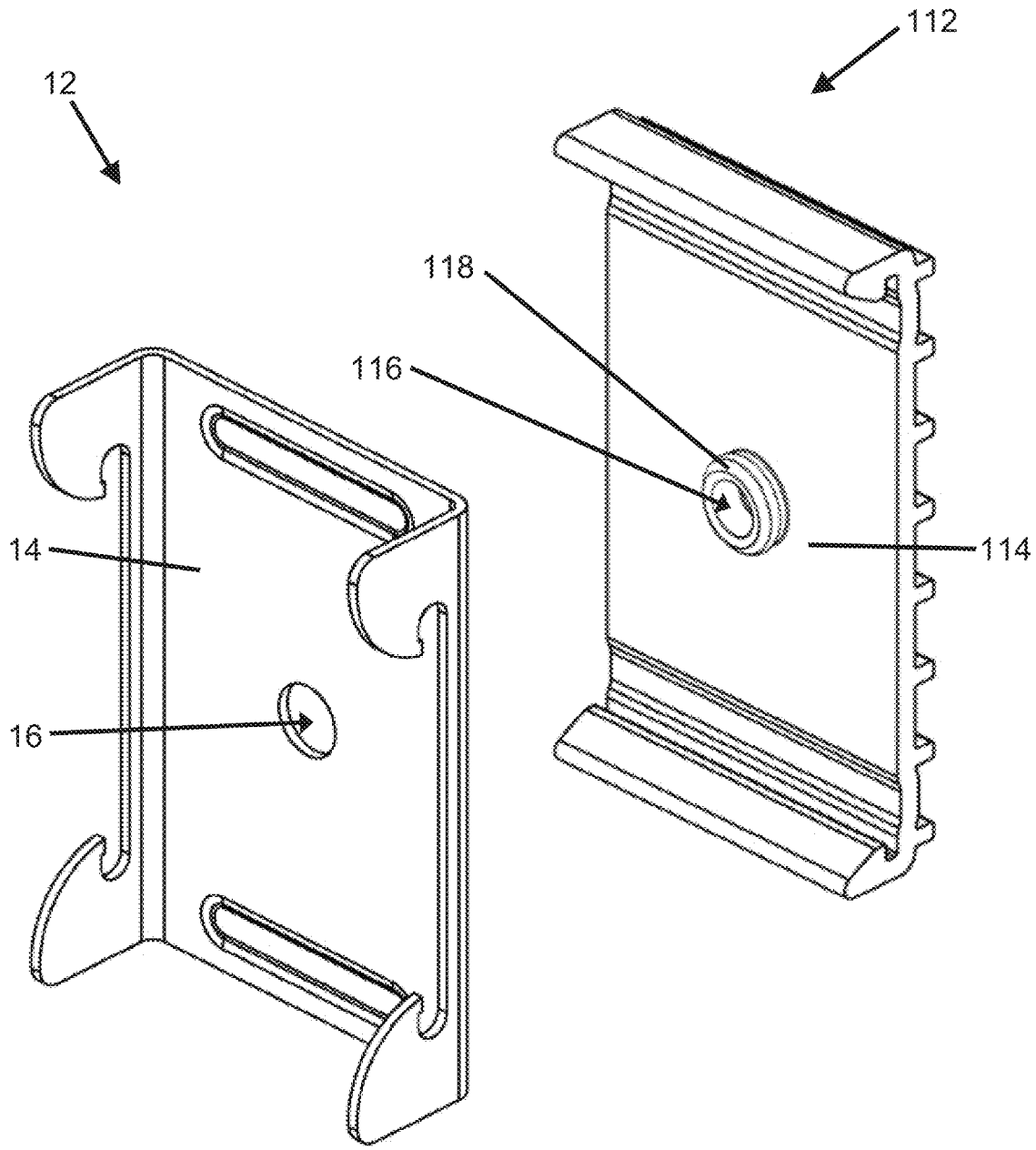
FIG. 8 is an exploded view of the clip assembly of FIG. 1 including a grommet to define an aperture in a clip insulation according to an embodiment of the present invention.

With reference to FIG. 8, there is shown the insulation member 112 according to an embodiment of the present invention. The insulation member 112 includes a bed portion 114. The bed portion 114 includes an aperture 116.

The insulation member 112 includes a grommet 118 extending from the bed portion 114. The aperture 116 extends through the grommet 118. In use, the grommet 118 is adapted to be at least partially inserted into the aperture 16 of the body portion 14 of the clip 12.

Advantages

An advantage of the preferred embodiment of the clip insulation includes the ability to further distance a clip from a support structure. Another advantage of the preferred embodiment of the clip insulation includes the ability to inhibit vibrations from traveling from a support structure to a furring channel A further advantage of the preferred embodiment of the clip assembly includes preventing direct contact between the clip and a fastener securing the clip to a support structure.

Variations

While the foregoing has been given by way of illustrative example of this invention, all such and other modifications and variations thereto as would be apparent to persons skilled in the art are deemed to fall within the broad scope and ambit of this invention as is herein set forth.

Throughout the description and claims of this specification the word "comprise" and variations of that word such as "comprises" and "comprising", are not intended to exclude other additives, components, integers or steps.

The invention claimed is:

1. A clip insulation for a furring channel clip, the clip insulation having a substantially planar bed portion having two opposed ends, the bed portion configured to at least cover a portion of an outer surface of the furring channel clip;

a plurality of projections extending from the bed portion; and two opposed skirt portions, each skirt portion extending from an end of the bed portion, each skirt portion configured to attach to a respective end of the furring channel clip, wherein each skirt portion comprises a ramp portion having a substantially tapered cross section, and wherein each of the ramp portions are configured to guide the clip insulation onto the respective ends of the furring channel clip.

2. The clip insulation as claimed in claim 1, the two opposed skirt portions extends at substantially 90° from the bed portion and each of the two opposed skirt portions defines a recess to receive the respective end of the clip to hold the clip insulation in place on the clip.

3. The clip insulation as claimed in claim 1, wherein the plurality of projections extend at substantially 90° from the bed portion.

4. The clip insulation as claimed in claim 1, wherein the insulation member includes a rubber material or a plastic material to inhibit or reduce vibrations from passing therethrough.

5. The clip insulation as claimed in claim 1, wherein the bed portion is substantially rectangular in shape.

6. The clip insulation as claimed in claim 1, wherein in use, when the clip is attached relative to a support structure, and the bed portion is located between the clip and the support structure.

7. The clip insulation as claimed in claim 1, wherein in use, the plurality of projections extend in a direction away from the clip.

8. The clip insulation as claimed in claim 1, wherein the plurality of projections extend in substantially the opposite direction compared to the two opposed skirt portions.

9. The clip insulation as claimed in claim 1, wherein the plurality of projections are knobs, nibs or lugs.

10. The clip insulation as claimed in claim 1, wherein the two opposed skirt portions each define a recess to receive the respective end of the clip to hold the clip insulation in place on the clip.

11. The clip insulation as claimed in claim 1, wherein the plurality of projections are ribs.

12. The clip insulation as claimed in claim 11, wherein the ribs are parallel to one another.

13. The clip insulation as claimed in claim 1, wherein the bed portion includes an aperture adapted to align with an aperture of the clip.

14. The clip insulation as claimed in claim 13, wherein the bed portion includes a grommet extending from the bed portion, the grommet is adapted to be at least partially inserted into an aperture of the clip.

15. The clip insulation as claimed in claim 14, wherein the grommet includes a rubber material to inhibit or reduce vibrations from passing therethrough.

16. A clip assembly for mounting a furring channel to a support structure, the clip assembly having a clip having a body portion configured to be attached to the support structure; and at least one connection portion extending transversely from the body portion, each of the at least one connection portion has two opposed connection positions configured to connect to the furring channel; and a clip insulation configured to be located between the clip and the support structure, the clip insulation having a substantially planar bed portion having two opposed ends, the bed portion configured to at least cover a portion of an outer surface of the clip;

a plurality of projections extending from the bed portion; and two opposed skirt portions, each skirt portion extending from an end of the bed portion, each skirt portion configured to attach to a respective end of the clip, wherein each skirt portion comprises a ramp portion having a substantially tapered cross section, and wherein each of the ramp portions are configured to guide the clip insulation onto the respective ends of the clip.

17. The clip assembly as claimed in claim 16, wherein in use, when the body portion is attached relative to the support structure, the bed portion and the plurality of projections are located between the support structure and the clip.

18. The clip assembly as claimed in claim 16, wherein the plurality of projections are ribs, knobs, nibs or lugs.

* * * * *